US005361904A

United States Patent [19]

Kapec et al.

[11] Patent Number: 5,361,904

[45] Date of Patent: Nov. 8, 1994

[54] COLOR CODED LABELING SYSTEM AND DISPENSER THEREFOR

[75] Inventors: Jeffrey Kapec, Westport, Conn.; Allan Chochinov, New York; Carl Froelich, Oceanside, both of N.Y.

[73] Assignee: Esselte Pendaflex Corporation, Garden City, N.Y.

[21] Appl. No.: 976,081

[22] Filed: Nov. 13, 1992

[51] Int. Cl.[5] ..... B65D 73/00

[52] U.S. Cl. ..... 206/460; 40/359; 206/459.5; 283/117

[58] Field of Search ..... 206/232, 447, 459.5, 206/460; 156/584; 283/45, 56, 58, 81, 117; 40/595, 596, 638, 359

[56] References Cited

U.S. PATENT DOCUMENTS

| | | | |
|---|---|---|---|
| 2,105,367 | 1/1938 | Parsons | 283/81 |
| 3,167,181 | 1/1965 | Goodman | 206/447 |
| 3,313,408 | 4/1967 | Endrizzi | 206/447 |
| 3,338,395 | 8/1967 | Silverstein | 206/460 |
| 3,350,805 | 11/1967 | Jorgensen | 283/117 |
| 3,361,252 | 1/1968 | Wise | 206/447 |
| 3,481,460 | 12/1969 | Watts | 206/460 |
| 4,355,824 | 10/1982 | Weber et al. | 283/81 |
| 4,389,963 | 6/1983 | Pearson | 206/459.5 |
| 4,976,351 | 12/1990 | Mangini et al. | 206/459.5 |
| 5,066,046 | 11/1991 | Hoopingarner | 283/81 |
| 5,195,123 | 3/1993 | Clement | 283/81 |

*Primary Examiner*—Jimmy G. Foster
*Attorney, Agent, or Firm*—Pennie & Edmonds

[57] ABSTRACT

A labeling system and storage and dispensing device for tab labels, for use with side tab folders for shelf filing systems or with top tab folders for drawer filing systems. The labeling system includes a plurality of tab labels having an adhesive backing. Each label has first and second side regions containing a white alpha-numeric character and a black background separated by a central colored region. The color of the central region is determined by the alpha-numeric character(s) formed on the side regions of the label. Patterns, such as lines or dots, may be combined with the solid colors, so that a given color may be used for more than one character. In further embodiments of the invention, the character(s) on the side regions may be oriented at right angles or at 180° relative to each other. The storage and dispensing device comprises a plurality of pads of labels, arranged in a predetermined array and mounted on a relatively stiff substantially planar support which includes a stand member for mounting the support at an angle with respect to a horizontal surface. The dispenser allows a large number of labels to be stored compactly, and facilitates quick selection by eliminating any need to flip through pages or files, as all characters are visible at one time. The pads are mounted individually, to allow replacement of pads of labels of specific characters as each character is needed.

38 Claims, 7 Drawing Sheets

A B C D E F G H I J K L

M N O P Q R S T U V W

X Y Z 1 2 3 4 5 6 7 8 9 0

FIG. 2

COLOR CODED LABELING SYSTEM AND DISPENSER THEREFOR

TECHNICAL FIELD

The invention relates to labeling systems, and, in particular, to a labeling system employing tab labels and a device for storing the labels and dispensing the same.

BACKGROUND OF THE INVENTION

Adhesive backed labels are well known in the art and frequently used in filing systems. Colored labels in combination with alpha-numeric characters are also known in the art. These existing label systems primarily employ labels having black or colored characters printed on a white or transparent background such as those disclosed, for example, in U.S. Pat. Nos. 4,445,711 and 4,204,639. Characters on these types of labels are often difficult to read since the characters are not in sharp contrast relative to the background.

Labeling systems using colored inks have also been developed. For example, U.S. Pat. No. 3,805,426 discloses labels of this type wherein the labels are color coded by reverse printing of a number on a tab using colored inks. U.S. Pat. No. 3,937,493 also discloses reverse printing of letters in colored ink for use in color coding documents.

These existing labeling methods do not achieve maximum visibility of the characters relative to the labels, however, because the colors used on the label are not high in contrast relative to the white characters. It is therefore desirable to provide an improved tab label with a visually improved image allowing for greater visibility of the character(s) thereon, while utilizing colors for coding of files.

Filing systems using many different labels require methods of storing and dispensing the labels in an organized, efficient manner. At a minimum, such systems commonly include at least 26 letter labels and 10 number labels. Often additional labels representing repetitively used information, such as the year, month, day, etc., are also included. Existing dispensers for such labels typically consist of rolls or sheets of labels for each individual alpha-numeric character. These dispensing systems have many disadvantages. The rolls of individual labels are cumbersome when a system requires several different characters. In an alphabetic filing system, for example, 26 different rolls would be needed, which would be bulky, unorganized, and easily misplaced. The sheets of labels are similarly inconvenient. It is difficult, as well as time-consuming first, to find the correct sheet, and then carefully detach a label without damaging adjacent labels.

Other dispensing systems include a three ring binder or an index card file for storing the labels. For example, U.S. Pat. No. 856,689 discloses a label package in which sheets of labels are bound in a book. However, these storing and dispensing systems are often cumbersome to look through and utilize a relatively large amount of desk top or storage space. Many dispensing systems also necessitate purchasing an entire set of replacement characters when one or two characters are depleted. It is therefore desirable to provide a dispensing system that is compact, organized, and efficient.

SUMMARY OF THE INVENTION

The present invention satisfies the above-stated needs by providing a labeling system for classifying and identifying a plurality of file folders with easy to read labels and a dispenser that is compact and reduces label waste. The label of the present invention has a front surface with two side regions separated by a central region, wherein indicia are formed in white upon a black background on each of the side regions and the central region includes an area defining and containing a designated color which corresponds to the indicia, resulting in high visibility of the characters and ease in coding files. The label may have an adhesive coating at least partially upon the back surface.

The indicia formed on the label comprises at least one alpha-numeric character, preferably printed in OPTIMA font. Also, the central region is separated from the side regions by curved lines so as to increase the size of the colored area of the central region compared to those having straight line boundaries. Advantageously, the adhesive coating comprises a pressure sensitive adhesive which substantially covers the entire back surface of the label, and is covered by a release paper.

The labels may include indicia thereon representing a letter of the alphabet or a numeral. If desired, the central region may further include a designated pattern corresponding to certain indicia of label. Thus, when the labels are adapted for use with tab folders, the indica formed on the first side regions are orientated at a right angle with respect to the indica formed on the second side region. Alternatively, the labels may be adapted for use with top tab folders, so that the indica formed on the first side regions may be oriented at a 180 degree angle with respect to the indicia formed on the second side region. These indicia orientations advantageously provide labels for use in shelf and drawer type filing systems, respectively.

The labels may further include an extended side region adjacent one of the side regions, with a machine readable bar code corresponding to the color and indica of the label being provided on the extended side region. Thus, the bar code would be visible from the outside surface of the folder, thus providing yet another method of coding files.

The invention also relates to a device for storing and dispensing a plurality of labels comprising a substantially planar support, and a plurality of pads arranged on the support. Each of the pads include a plurality of labels, each label having a front surface and a back surface having an adhesive coating at least partially thereupon, with each label being retained in the pad by at least temporarily being associated with an adjacent label or the planar support. If desired, some of the pads may include labels having indicia formed thereon and/or regions which are color coded or patterned to correspond to the indicia. The labels described above may be used with this support although a wide variety of other types of pressure sensitive labels may also be dispensed with this device.

The pads are generally arranged on the support in an array comprising a plurality of rows and columns such that all label pads are visible to facilitate label location and selection for quick accessibility by a user. The support provides a compact area in which to store and dispense labels without the need to flip through cards or pages in a filing system, or find the correct dispenser among many individual character dispensers. Advantageously, the labels are provided with indicia thereon, the adhesive coating is covered with a release layer, the pads are secured to the support.

In this regard, the invention also relates to a method of storing and dispensing a plurality of labels having a front surface and a back surface that has an adhesive coating at least partially thereupon. This method includes the steps of providing a substantially planar support; arranging a plurality of pads of the labels on the support in a selected array comprising at least two rows and two columns; and affixing the label pads to the support in the selected array.

Preferably, the indicia includes the letters of the alphabet or numerals and the pads are arranged on the support in an N X M array of rows and columns, where N and M are the same or different and preferably are integers of 2 to 10, to display each letter or numeral. For the alphabet letters, the pads may be arranged in a 5 × 6 array (i.e., 26 letters and 4 additional labels to designate years or other information), while for single digit numerals, the pads may be arranged in a 2 × 5 array.

The individual pads ensure that each label can be easily removed from the pad of labels for that particular character without damaging other labels in the process. In addition, when a given a pad is depleted, only that pad need be replaced on the support, thereby eliminating the need to purchase a complete set of labels when only a few characters are missing. Each label is easily visible by looking at the support, the pads of labels being arranged in a logical order, e.g., alphabetically or numerically.

The storing and dispensing device of the present invention may also include means for mounting the planar support at an angle with respect to a horizontal surface for viewing and selecting said labels. In one embodiment, the mounting means comprises an aperture for mounting on a hook or nail of a vertical surface. Alternatively, the mounting means comprises a stand which enables the support to be free-standing upon a substantially horizontal surface. This stand member preferably includes a first back portion which is hingedly attached to the planar support, a first base portion hingedly attached to the back portion, and a second base portion hingedly attached to both the first base portion and the planar support so that the back and base portions can fold substantially flat against the planar support in a first position, or can be unfolded to a second position to form the stand member. For compactness, the back and base portions each have a width which is less than that of the planar support.

Accordingly, the present invention provides a labeling system that consists of labels, which use color coding and also have the benefit of characters which are highly visible due to reverse white on black printing, and a dispenser for the labels which allows a user to view all the characters on a single planar support for quick identification and removal of the desired label, while providing for replacement of individual pads of labels when necessary.

BRIEF DESCRIPTION OF THE DRAWINGS

The above features and advantages of the present invention will become apparent from the following detailed description of the preferred embodiments of the invention as illustrated in the accompanying drawings, wherein:

FIG. 2 is a compilation of alpha-numeric characters in OPTIMA font;

DETAILED DESCRIPTION OF THE INVENTION

Figure 1:
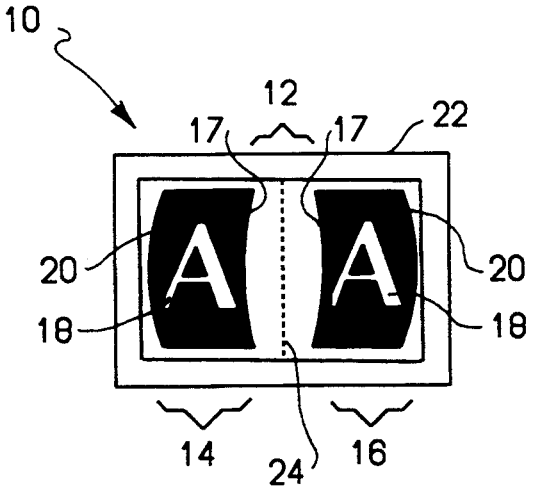
FIGS. 1 and 1A and FIG. 1B are plan views of labels in accordance with the teachings of the present invention.

FIG. 1 illustrates a label 10 in accordance with the present invention. The label 10 is generally rectangular and comprises a first side region 14 and a second side region 16 separated by curved lines generally designated 17 from a central region 12. Each side region 14, 16 includes indicia such as an alpha-numeric character 18 formed in white on a black background 20 thereon.

The label 10 of the present invention is particularly adapted for use in connection with shelf or drawer filing systems, such as those commonly employed by medical and dental offices to identify patient files. The central region of the label is colored in accordance with the alpha-numeric character printed thereon to provide easy identification, storage and retrieval of folders in the filing system.

Figure 1A:
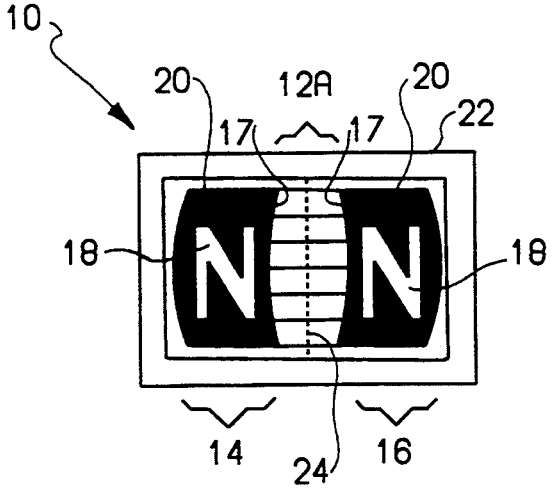
Figure 1B:
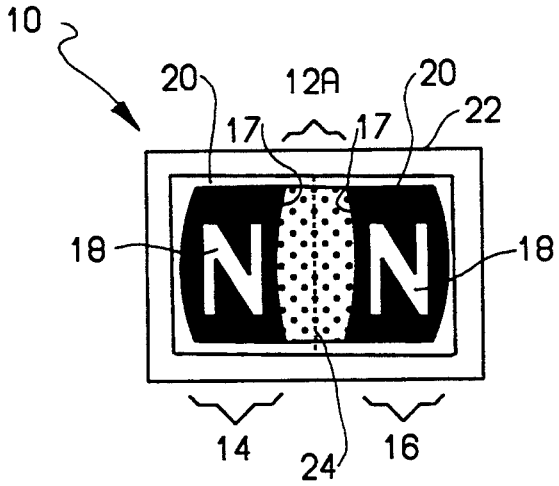

Preferably, a different color is used for each character, or to reduce the number of colors needed, the colors in the central region could be lined or patterned. In an alphabetical system, for example, 13 colors could be used with each color repeated once with a lined pattern instead of a solid pattern. FIG. 1A illustrates a label for the 14th letter, N, which uses the same color in the central region 12 as the first letter A but includes a horizontal line pattern. Thus, the 15th to 26th letters (i.e., O to Z) would have central regions with the same colors as the 2nd to 13th letters (i.e., B to M) but with the horizontal line pattern for differentiation. An additional pattern, such as dots or a grid of horizontal and vertical lines, could be used to further reduce the number of colors needed. FIG. 1B illustrates the use of a dot pattern as a background. Thus, only nine colors are needed if a second pattern is used in addition to the first pattern.

Table 1 below sets forth a preferred configuration of colors to be identified with each alpha-numeric character in the labeling system of the present invention, wherein patterns are utilized in addition to solids to distinguish individual characters in a group associated with a particular color. The second letter in each row, i.e., N through Z, have the same colors as letters A through M, respectively, but include horizontal lines therethrough as shown in FIG. 1A to distinguish those letters from the previous letters.

| CHARACTER | COLOR | PMS Color No. |
|---|---|---|
| A, N, O | RED | 199C |
| B, O, 1 | ORANGE | 165C |
| C, P, 2, '92 | YELLOW | YELLOW |

-continued

| CHARACTER | COLOR | PMS Color No. |
|---|---|---|
| D, Q, 3, '93 | TURQUOISE | 3125C |
| E, R, 4, '94 | TAN | 465C |
| F, S, 5, '95 | GREEN | 347C |
| G, T, 6, '96 | LIGHT GREEN | 375C |
| H, U, 7 | SALMON | 486C |
| I, V, 8 | VIOLET | 2665C |
| J, W | DARK BLUE | 3005C |
| K, X, 9 | PINK | 211C |
| L, Y | PALE BLUE | 278C |
| M, Z | GREY | 421C |

A preferred font for providing ease of readability of the alpha-numeric characters 18 has been found to be the OPTIMA font. FIG. 2 is a display of the particular alpha-numeric characters in this font. As noted above, the characters are white and placed on a black background for high visibility compared to prior art labeling systems that use black or colored characters on a white background.

The curved lines 17 separating the side regions from the central region on the label act to maximize the area of the central region, thereby maximizing the area available for the colored portion of the label. This enlarged, substantially oval, colored region 12, in combination with the white lettering of the alpha-numeric character upon the black background adjacent the color region, ensure that maximum contrast is achieved between the letter, background, and color code to provide a label that is highly visible to the user. When implemented in a shelf or drawer filing system, the contrasting character and color provided on the label of the present invention facilitate locating and subsequent refiling of folders, thereby increasing efficiency. Also, incorrectly filed folders are easy to identify for refiling.

Figure 3:
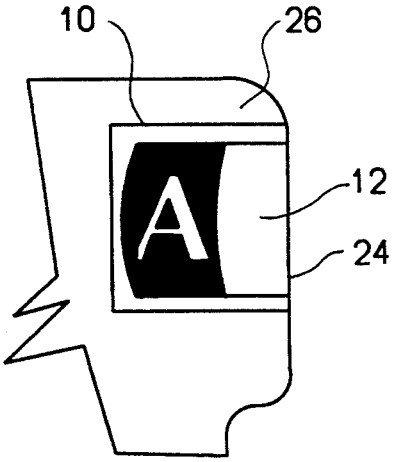
FIG. 3 is a plan view of the label folded and attached to a file folder.

The label has a pressure sensitive backing mounted on a release paper 22 which is removed in a well-known manner when the label is to be applied to a file folder. FIG. 3 illustrates the label 10 as applied to a tab member of a file folder adapted for shelf filing systems. To attach the label 10 to the tab member, the label is first peeled from the release paper to expose the pressure sensitive backing. The label is then folded over the tab member along a center line 24 which longitudinally bisects the central region 12 such that the alpha-numeric character on the label is visible from each side of the folder. When affixed in this manner, the colored center region is placed along the edge of the tab member 26 to further aid identification and speed file retrieval.

Figure 4:
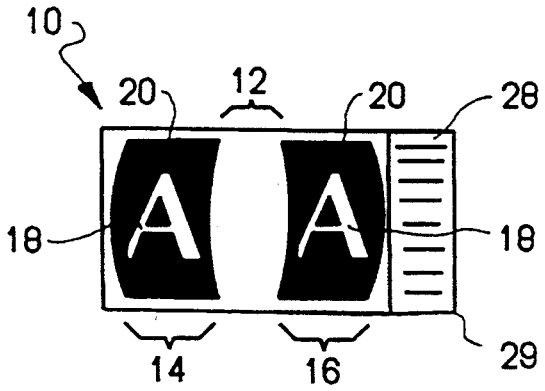
FIG. 4 is a plan view of the variation of the label which includes a bar code.

Referring now to FIG. 4, an additional embodiment of the label 10 further includes an identifying bar code 28 printed on an extended side region 29 adjacent the second side region of the label. Alternatively, the bar code could be printed on an extended side region adjacent the first side region. The label is placed on the tab member of a file folder a manner similar to that described above. The bar code is thus positioned on the back side of the tab member, extending beyond the shelf in order to provide access for scanning. The bar code provides for another method of coding file folders which is fully discussed in U.S. Pat. Nos. 4,204,639 and 4,329,191, the contents of which are expressly incorporated herein by reference thereto. The use of a bar code in combination with the label of this invention is desirable for use with the filing systems described in those patents.

Figure 5:
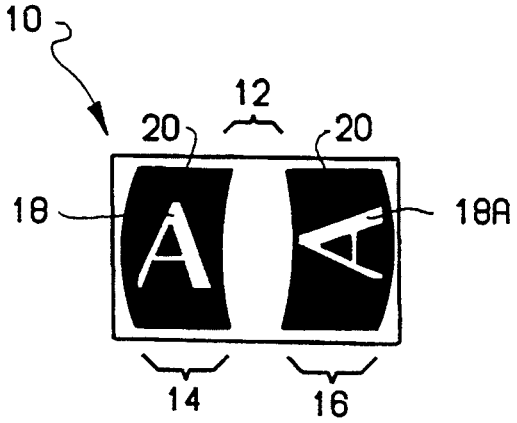
FIG. 5 is a plan view of the label with the alpha-numeric character of the first side region oriented at right angles to the character of the second side region.
Figure 6:
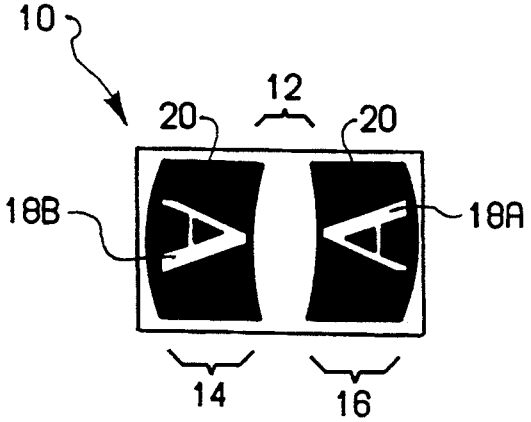
FIG. 6 is a plan view of the label with the alpha-numeric character of the first side region oriented at 180 degrees to the character of the second side region.

FIGS. 5 and 6 illustrate further embodiments of labels which could be utilized in the labelling system of the present invention. These embodiments provide the user with alternative labels that are appropriate for specific filing system needs. As shown in FIG. 5, one alpha-numeric character could be oriented at a angle, such as 90 or 180 degrees, to another alpha-numeric character on the label. For example, the alpha-numeric character 18A on the second side region 16 of the label could be oriented at a ninety degree angle with respect to the character 18 on the first side 14 region, such as is illustrated in FIG. 5. This feature is particularly desirable when used in connection with side tab folders in shelf filing systems illustrated by U.S. Pat. No. 3,937,493, the content of which is expressly incorporated herein by reference thereto.

FIG. 6 illustrates a label on which the alphanumeric character 18A on the second side region 16 is oriented at a one hundred eighty degree angle with respect to the alpha-numeric character 18B on the first side region of the label. This orientation is useful for top tab folders which are filed in drawer filing systems.

In addition to the label configurations described above, it will be appreciated that each side region of the label could also include two or more alpha-numeric characters (not shown) for more complex labeling system needs. These multiple characters can be used in tandem for indexing (i.e. SA, SB, etc.). In addition, multiple characters could be oriented at different angles for easy reading of the label despite the position of the folder. For example, when two identical characters are used on one side region, they could be oriented at 90° so that the label can be read vertically or horizontally. Further, it will be readily apparent that character/color configurations different from that set forth above could also be used in any particular filing system.

The label storage and dispensing device of the present invention is illustrated in FIGS. 7–10. The device includes a generally rectangular support 30 preferably formed of cardboard, heavy-weight paper, plastic or another suitable stiff material. The storage and dispensing device further includes a plurality of labels 10 affixed to the support. The labels are configured as described above to include two side portions having an alpha-numeric character in white on a contrasting black background formed thereon. As described above, the labels further include a central region between the two side regions which is colored in accordance with the alpha-numeric character formed on the label.

The labels are arranged in stacks having adhesive applied thereto, such as along one edge, to form pads 32 wherein the top label of the pad is held to the stack of remaining labels. Preferably, one pad of labels is provided for each desired alpha-numeric character in the filing system. The pads are arranged in a selected array of rows and columns on the support 30, in a logical order (preferably alphabetically or numerically depending upon the characters used) and are attached to the support 30 by any suitable adhesive. As all labels can be viewed at once by a user, quick location of a particular label on the support is advantageously facilitated.

Figure 7:
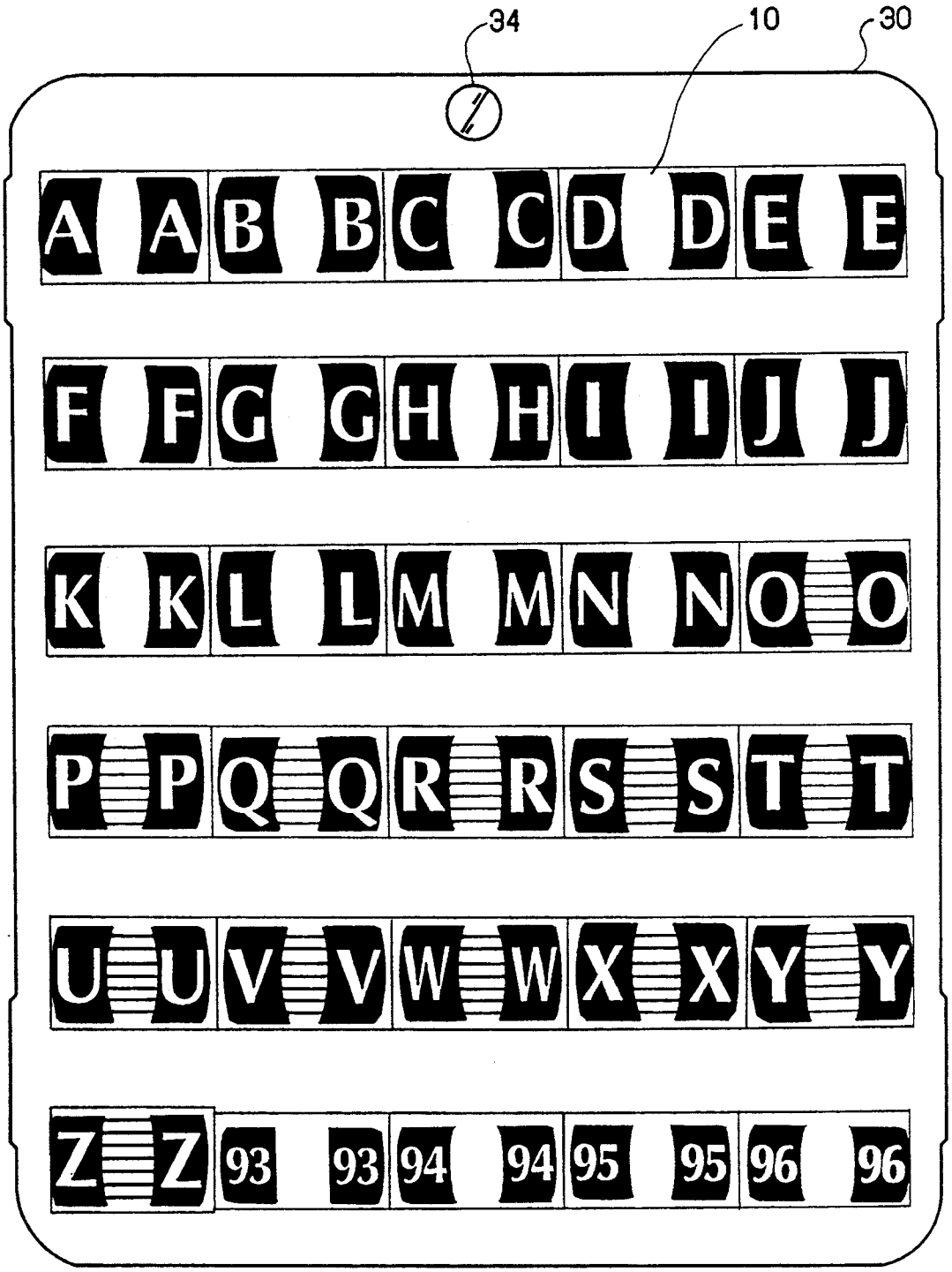
FIG. 7 is a front view of the dispenser for the labeling system.

In one specific construction of the invention, the support is approximately 9 by 11½ inches, and holds 30 pads of labels in an array of five rows and six columns (i.e. 5 × 6), as shown in FIG. 7. This particular construction would enable all 26 alphabet labels to be displayed, as well as four additional labels, which could represent the four fiscal quarters of a given year, four years, or other commonly used numbers or characters in a particular filing system. Alternatively, the dispenser 30 could be even more compact, and contain ten labels, one for each numerical digit, in an array of two rows and five columns (i.e., 2 × 5). In another arrangement a 3 × 4 arrangement could be used for the ten digits and 2 additional characters, such as years. In addition, a finite number of repetitively used characters or letters (i.e., R,S,T,N,L,E; etc) could be included on a dispenser in an array of N X M rows and columns, where N and M are the same or different and preferably are integers of 2 to 10 (e.g., 2 × 2, 3 × 6, 6 × 8, etc.). These embodiments would allow a user to implement a numerical filing system while needing only a minimum of desk top space for the dispenser.

Figure 8:
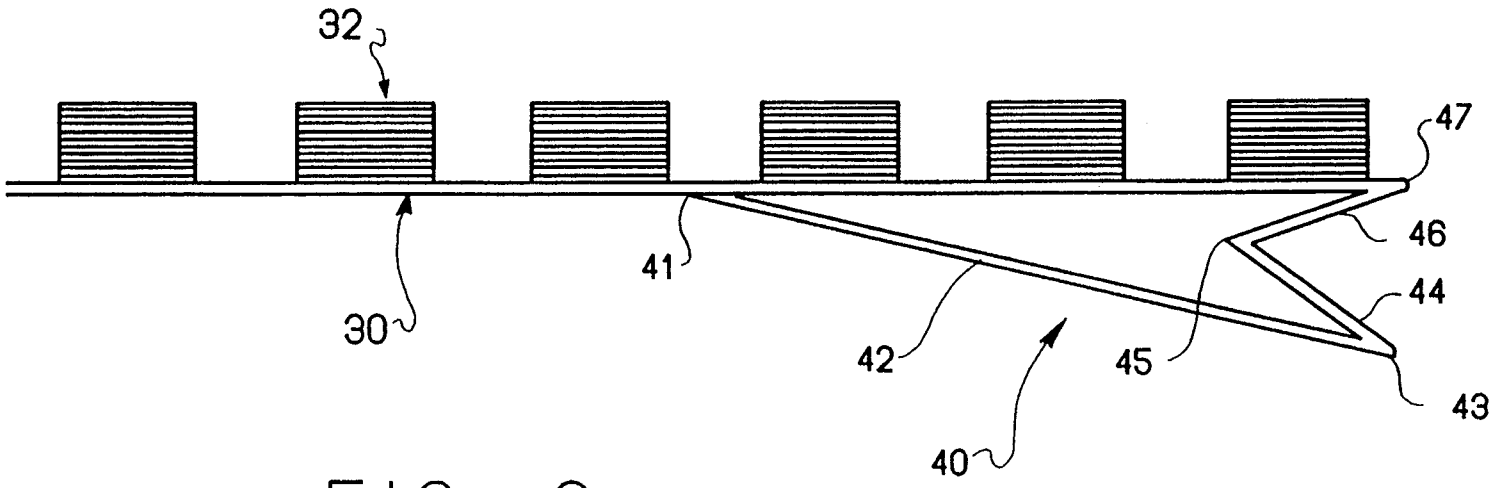
FIG. 8 is a side view of the dispenser of FIG. 7.

FIG. 8 is a side view illustrating the arrangement of the labels into individual pads 32. In this manner, the labels can be quickly and easily removed by pulling at an edge of an individual label to separate it from the rest of the pad. This arrangement provides an effective way of dispensing labels which prevents damage of adjacent labels, as is possible with sheet or roll systems.

The support 30 may include an aperture 34 which enables the dispenser to be mounted on a hook or nail upon a vertical surface, such as a wall. This allows the dispenser to be removed from the work spaces of a desk or table when not being used, so that the work spaces can be used for other tasks. Thus, the labels remain viewable even when the dispenser is mounted, so that labels can be easily viewed and accessed without having to retrieve the dispenser from storage.

Figure 9:
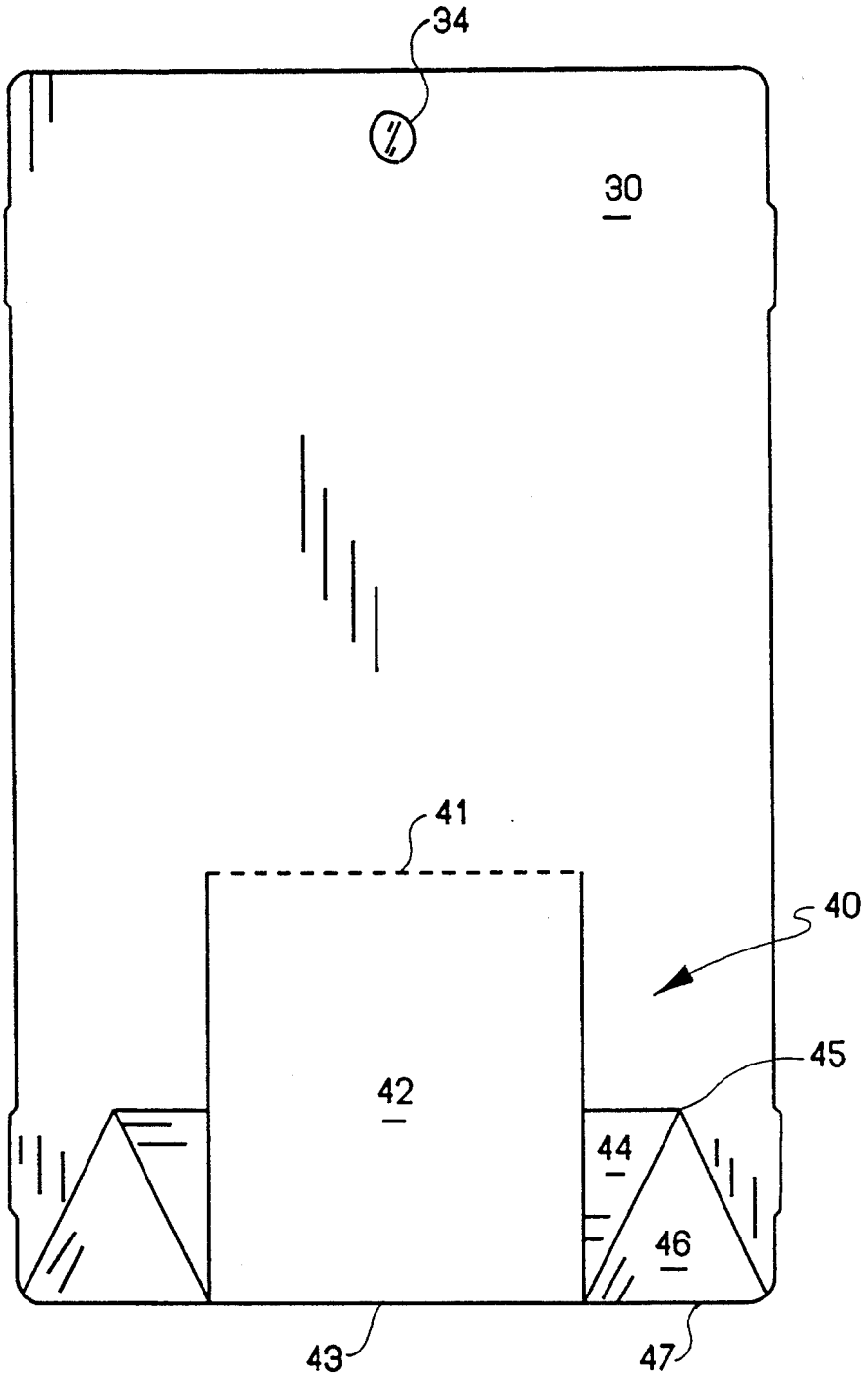
FIG. 9 is a back view of the dispenser of FIG. 7.
Figure 10:
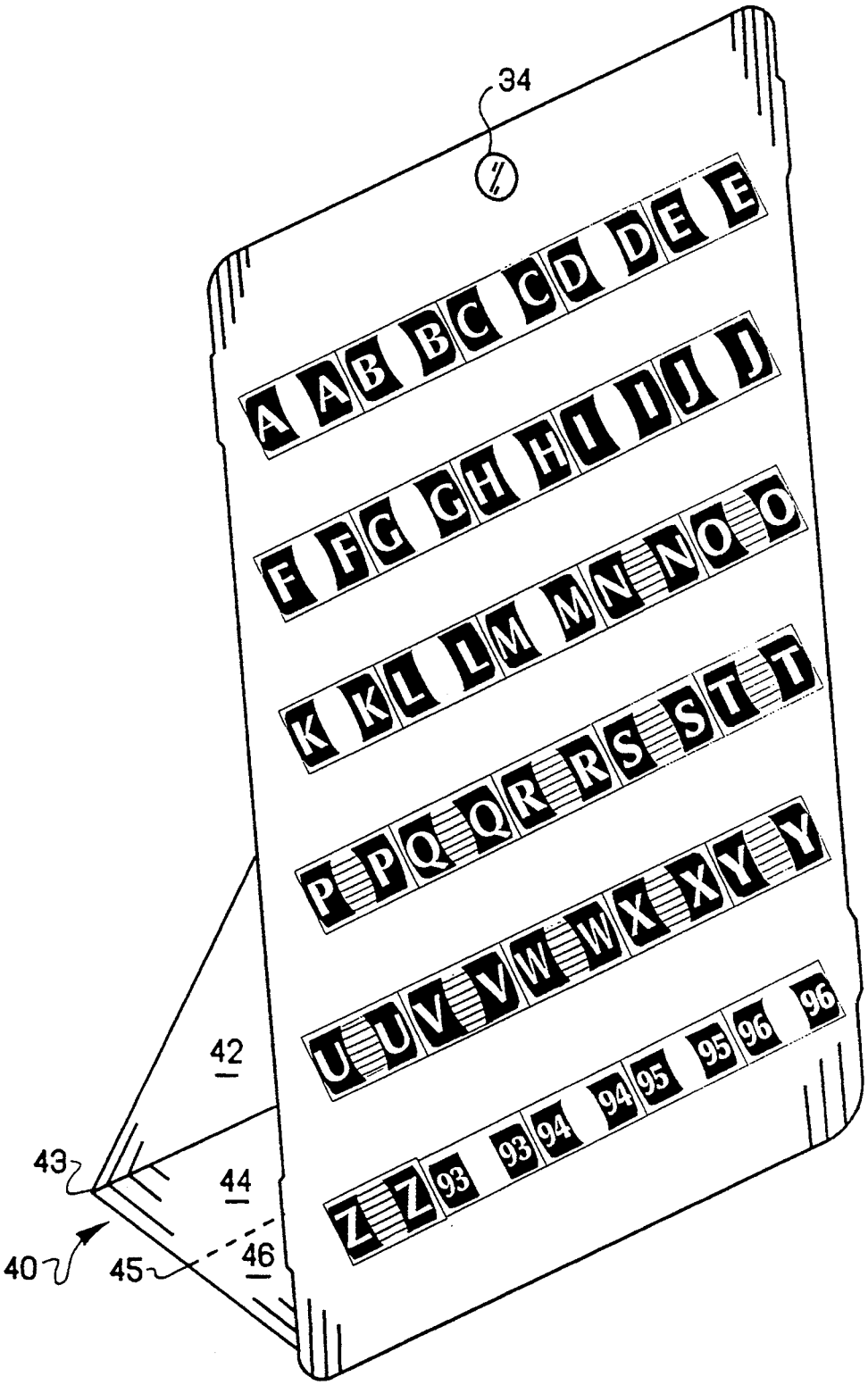
FIG. 10 is a perspective view of the dispenser of FIG. 7 in its operative position.

FIGS. 8–10 illustrate an alternative embodiment for conserving work space with the dispenser of the invention. In this embodiment, a stand 40 is built in to the back of the planar support. This stand has three components, a back portion 42, a first base portion 44 and a second base portion 46. These portions are hingedly connected so that they can be folded compactly, or opened to the position shown in FIG. 10. These hinged connections can be made by placing perforations in the cardboard material that is used to made these portions. These perforations are located along fold lines 41, 43, 45 and 47. When these portions are unfolded, the stand 40 is formed and the dispenser may be placed in an upstanding position on a relatively flat or horizontal surface. This embodiment also conserves work space in a manner which enables the labels to be displayed and viewed.

Other types of stands can also be used although the one described above is preferred. The "tie-shaped" stands of the type-utilized for stand-up photograph frames can be used if desired. Also, a rear panel which is attached to the planar support and form an "A" frame (in side view) can be used. One skilled in the art is aware of a number of additional stand members or frames which could be used to enable the dispenser to be free-standing on a substantially horizontal surface.

In the preferred use of the invention, a user need only look at the dispenser 30, see the label 10 that is desired, remove it from the pad 32 of the desired character, remove the release paper 22, and apply the label 10 to a tab member of a file folder 26 by folding it along the center fold line 24 as described above. When affixed to a file in this manner, the colored central region of the label will be located along the edge of the tab member, and the character(s) will be visible from either the front or the back of the tab member. When a user has depleted a pad of labels of a particular character(s), only one pad containing that particular character need be purchased and replaced. The replacement pad can be fixed on the support with adhesive in the same position as was the original pad prior to depletion.

Other dispenser configurations will be apparent based upon the type of filing system employed by the user. It will be appreciated that use of the label storage and dispensing device is not limited to color coded tab labels, and that the device could also be used in connection with any type of pressure-sensitive adhesive labels, such as mailing labels, routing labels, etc. One skilled in the art is able to configure an arrangement of the desired labels on the support in accordance with the particular needs of the office or mailroom where the labels will be used.

As will be apparent to those skilled in the art, other various modifications and adaptations of the embodiments described above will become readily apparent without departure from the spirit and scope of the invention, the scope of which is defined in the appended claims.

What is claimed is:

1. A device for storing and dispensing a plurality of labels comprising:

a substantially planar support;

a plurality of pads arranged on said support, each of said pads comprising a plurality of labels, each label having a front surface and a back surface having an adhesive coating at least partially thereupon, each label retained in the pad by at least temporarily being associated with an adjacent label or the planar support;

wherein each label in a pad has the same indicia formed thereon as other labels in said pad;

wherein at least a first pad has a colored region on each label which designates the indicia thereon, and a second pad has different colored region to designate the indica thereon, wherein the colored region on the first pad is different than the colored region of the second pad; and wherein the indicia of one pad is not repeated on any other pad on the support with a different colored region.

2. The device of claim 1, wherein at least some of the pads include labels having at least two of the same indicia formed thereon.

3. The device defined in claim 1, wherein said pads are arranged on said support in an array comprising a plurality of rows and columns.

4. The device defined in claim 1, wherein said indicia on said labels are formed as white characters on a black background.

5. The device defined in claim 1 which further comprises means for mounting the planar support at an angle with respect to a horizontal surface for viewing and selecting said labels.

6. The storing and dispensing device defined in claim 5 wherein the mounting means comprises an aperture.

7. The storing and dispensing device defined in claim 5 wherein the mounting means comprises a stand member which enables the support to be free-standing upon a substantially horizontal surface.

8. The storing and dispensing device defined in claim 7 wherein the stand member forms a portion of the planar support.

9. The storing and dispensing device defined in claim 8 wherein the stand member includes a back portion hingedly attached to the planar support, a first base portion hingedly attached to back portion and a second base portion hingedly attached to the first base portion and the planar support, such that the back and base portions can fold substantially flat against the planar support in a first position, or can be unfolded to a second position to form the stand member.

10. The device defined in claim 9 wherein the back and base portions each have a width which is less than that of the planar support.

11. The device defined in claim 1 wherein said indicia of one pad is not identically repeated on any other pad on the support.

12. A device for storing and dispensing a plurality of labels comprising:

a substantially planar support;

a plurality of pads arranged on said support, each of said pads comprising a plurality of labels, each label having a front surface and a back surface having an adhesive coating at least partially thereupon, each label retained in the pad by at least temporarily being associated with an adjacent label or the planar support; and at least some of said pads include labels having indicia formed thereon; and wherein said labels include first and second side regions separated by a central region, said indicia formed on said first and second side regions, said central region colored in a designated color or pattern which corresponds to said indicia.

13. The device defined in claim 12, wherein said central region is separated from said side regions by curved lines to maximize the colored area on said label.

14. The device defined in claim 12, wherein said indicia formed on said label comprises at least one alpha-numeric character.

15. The device defined in claim 12, wherein said at least one alpha-numeric character is printed in OPTIMA font.

16. The device defined in claim 12, wherein said adhesive coating comprises a pressure sensitive adhesive covering substantially the entire back surface of the label.

17. The device defined in claim 12, wherein said adhesive coating is covered by a release paper.

18. The device defined in claim 12, wherein said labels each include indicia thereon representing at least one letter of the alphabet or at least one numeral.

19. The device defined in claim 12, wherein said central region further includes a designated pattern corresponding to certain indicia of said label.

20. The device defined in claim 12, wherein said labels are adapted for use with side tab folders and wherein said indicia formed on said first side regions are orientated at a right angle with respect to said indica formed on said second side region.

21. The device defined in claim 12, wherein said labels are adapted for use with top tab folders and wherein indica formed on said first side regions is oriented at a 180 degree angle with respect to said indicia formed on said second side region.

22. The device defined in claim 12, wherein said labels further include an extended side region adjacent one of said side regions, wherein said extended side region contains a machine readable bar code corresponding to the color and indica of said label.

23. A device for storing and dispensing a plurality of labels having at least one alpha-numeric character formed thereon comprising:

a planar support;

a plurality of label pads affixed to said support, each of said label pads comprising a plurality of labels affixed to one another wherein each label in said pad includes first and second side regions separated by a central region, and each first and second side regions has the same alpha-numeric character formed thereon, said central region having a predetermined color corresponding to said at least one alpha-numeric character, wherein said label pads are arranged on said support in a selected array of rows and columns such that all label pads are visible to facilitate label location and selection; and means for mounting the planar support at an angle with respect to a horizontal surface for viewing and selecting said labels.

24. The device defined in claim 23, wherein said central region of selected characters has a pattern therein and each label has a front surface and a back surface having an adhesive coating at least partially thereupon.

25. The device defined in claim 23, wherein said at least one alpha-numeric character is formed in white on a black background.

26. The device defined in claim 25, wherein said at least one alpha-numeric character is printed in OPTIMA font.

27. The device defined in claim 23, wherein said adhesive coating comprises a pressure sensitive adhesive covering substantially the entire back surface of the label.

28. The device defined in claim 23, wherein the mounting means comprises a stand member which enables the support to be free-standing upon a substantially horizontal surface.

29. The device defined in claim 28, wherein the stand member forms a portion of the planar support.

30. A device for storing and dispensing a plurality of labels having at least one alpha-numeric character formed thereon comprising:

a planar support;

a plurality of label pads affixed to said support, each of said label pads comprising a plurality of labels affixed to one another wherein each label in any one pad has the same alpha-numeric character formed thereon, each label further including a region having a predetermined color corresponding to said at least one alpha-numeric character, wherein said label pads are arranged on said support in a selected array of rows and columns such that all label pads are visible to facilitate label location and selection;

a stand member that enables the planar support to be free standing upon a substantially horizontal surface; and wherein the stand member forms a portion of the planar support and includes a back portion hingedly attached to the planar support, a first base portion hingedly attached to back portion and a second base portion hingedly attached to the first base portion and the planar support, such that the back and base portions can fold substantially flat against the planar support in a first position, or can be unfolded to a second position to form the stand member.

31. The device defined in claim 30 wherein the back and base portions each have a width which is less than that of the planar support.

32. A device for storing and dispensing a plurality of labels comprising:

a substantially planar support;

a plurality of pads arranged on said support, each of said pads comprising a plurality a labels, each label having a front surface and a back surface having an adhesive coating at least partially thereupon, each label retained in the pad by at least temporarily being associated with an adjacent label or the planar support;

wherein each label in a pad has the same indicia formed thereon as other labels in said pad;

wherein at least a first pad has a colored pattern region on each label which designates the indicia thereon, and a second pad has a different colored pattern region to designate the indicia thereon, wherein the colored pattern region of the first pad is different than the colored pattern region of the second pad; and wherein the indicia of one pad is not repeated on any other pad on the support with a different colored pattern region.

33. The device defined in claim 32 wherein said indicia of one pad is not identically repeated on any other pad on the support.

34. The device of claim 32 wherein the colored pattern of the label in a pad is a solid color.

35. The device of claim 32 wherein the colored pattern of the label is formed by lines on a colored background.

36. The device of claim 32 wherein the colored pattern of a label is formed by dots on a colored background.

37. A device for storing and dispensing a plurality of labels comprising:

a planar support;

a plurality of label pads affixed to said support; and a stand member that enables the planar support to be free standing upon a substantially horizontal surface; and wherein the stand member forms a portion of the planar support and includes a back portion hingedly attached to the planar support, a first base portion hingedly attached to back portion and a second base portion hingedly attached to the first base portion and the planar support, such that the back and base portions can fold substantially flat against the planar support in a first position, or can be unfolded to a second position to form the stand member.

38. The device defined in claim 37 wherein the back and base portions each have a width which is less than that of the planar support.

* * * * *